US010100561B2

(12) United States Patent
Da Deppo et al.

(10) Patent No.: US 10,100,561 B2
(45) Date of Patent: Oct. 16, 2018

(54) VEHICULAR DOOR HANDLE WITH ELECTRICALLY DEPLOYABLE LATCH CONNECTION AND OVERLOAD COMPENSATING DEVICE

(71) Applicant: Huf North America Automotive Parts Mfg. Corp., Milwaukee, WI (US)

(72) Inventors: Lynn D. Da Deppo, Bloomfield Hills, MI (US); Ehab Kamal, Novi, MI (US)

(73) Assignee: Huf North America Automotive Parts Manufacturing Corp., Milwaukee, WI (US)

( * ) Notice: Subject to any disclaimer, the term of this patent is extended or adjusted under 35 U.S.C. 154(b) by 843 days.

(21) Appl. No.: 14/580,455

(22) Filed: Dec. 23, 2014

(65) Prior Publication Data

US 2015/0184431 A1 Jul. 2, 2015

Related U.S. Application Data

(60) Provisional application No. 61/922,491, filed on Dec. 31, 2013.

(51) Int. Cl.

| | |
|---|---|
| ***E05B 3/00*** | (2006.01) |
| ***E05B 85/10*** | (2014.01) |
| ***E05B 77/06*** | (2014.01) |
| ***E05B 17/00*** | (2006.01) |
| ***E05B 81/46*** | (2014.01) |
| *E05B 1/00* | (2006.01) |
| *E05B 79/20* | (2014.01) |
| *E05B 79/22* | (2014.01) |

(52) U.S. Cl.

CPC ..... *E05B 85/10* (2013.01); *E05B 17/0058* (2013.01); *E05B 77/06* (2013.01); *E05B 81/46* (2013.01); *E05B 79/20* (2013.01); *E05B 79/22* (2013.01); *E05B 81/77* (2013.01); *Y10T 292/57* (2015.04)

(58) Field of Classification Search

CPC ..... E05B 81/64; E05B 81/76; E05B 81/77; E05B 81/78; E05B 85/10

USPC ..... 292/336.3

See application file for complete search history.

(56) References Cited

U.S. PATENT DOCUMENTS

| | | | | |
|---|---|---|---|---|
| 6,038,895 | A * | 3/2000 | Menke | B60R 25/24 70/223 |
| 6,264,257 | B1 * | 7/2001 | Meinke | E05B 85/10 292/336.3 |
| 8,701,353 | B2 * | 4/2014 | Patel | E05L 381/34 292/144 |
| 8,894,108 | B2 * | 11/2014 | Corwin | E05L 377/06 292/336.3 |
| 9,605,452 | B2 * | 3/2017 | Yoshino | E05B 85/103 |
| 9,695,614 | B2 * | 7/2017 | Jeong | E05L 31/0038 |

(Continued)

FOREIGN PATENT DOCUMENTS

| | | | | |
|---|---|---|---|---|
| DE | 19626914 | C1 * | 10/1997 | E05B 81/14 |
| DE | 19731325 | * | 1/1999 | |

(Continued)

*Primary Examiner* — Carlos Lugo

(74) *Attorney, Agent, or Firm* — Honigman Miller Schwartz and Cohn LLP; Matthew H. Szalach; Jonathan P. O'Brien

(57) ABSTRACT

A handle assembly including a path of transmission of a force for releasing a latch through the handle assembly that can be broken under extreme loading conditions.

9 Claims, 8 Drawing Sheets

(56) References Cited

U.S. PATENT DOCUMENTS

| | | | | |
|---|---|---|---|---|
| 2011/0148575 | A1* | 6/2011 | Sobecki | E05L 385/107<br>340/5.64 |
| 2012/0267905 | A1* | 10/2012 | Debroucke | E05B 15/04<br>292/336.3 |
| 2014/0132012 | A1* | 5/2014 | Yoshino | E05B 85/103<br>292/336.3 |
| 2014/0265372 | A1* | 9/2014 | Smart | E05B 85/103<br>292/336.3 |

FOREIGN PATENT DOCUMENTS

| | | | | |
|---|---|---|---|---|
| FR | 2755991 | A1 * | 5/1998 | E05B 81/06 |
| WO | WO-2008065080 | A1 * | 6/2008 | B60S 1/3493 |

* cited by examiner

VEHICULAR DOOR HANDLE WITH ELECTRICALLY DEPLOYABLE LATCH CONNECTION AND OVERLOAD COMPENSATING DEVICE

CROSS-REFERENCE TO RELATED APPLICATIONS

This application claims the benefit of U.S. Provisional Patent Application No. 61/922,491 entitled "Vehicular Door Handle with Electronically Deployable Latch Connection and Overload Compensating Device" filed on Dec. 31, 2013. The contents of that application are hereby incorporated by reference as if set forth in their entirety herein.

STATEMENT OF FEDERALLY SPONSORED RESEARCH OR DEVELOPMENT

Not applicable.

BACKGROUND

This disclosure relates to a handle assembly, such as an exterior door handle, for a motor vehicle door.

Motor vehicles include doors having exterior door handles that are coupled to an associated door latch mechanism for opening the door. Typically, a user actuates the door handle by pulling a strap portion of the handle relative to a base portion of the handle, which is rigidly mounted to the door. As long is the door is unlocked, this pulling action mechanically and/or electrically causes the door to unlatch, thereby permitting the door to be pulled open. Under typical use conditions, the user pulls the strap portion of the handle using a relatively low load in order to release the door latch mechanism and open the door.

However, the handle assembly is often subjected to more extreme loading conditions. Under extreme loading conditions, the door might be unintentionally unlatched (causing a dangerous door-open condition at a time when it is important for the door to remain closed) or the door assembly might be damaged.

As one example of an extreme loading condition, during an accident a vehicle might be subjected to a high inertia force. Such forces present the possibility that the door latch mechanism can be unlatched by virtue of relative movement of the handle strap portion or other portions of the door latch mechanism relative to the door. In recent years, there has been development of locking mechanisms to attempt to prevent the opening of a door in the event of such a high inertia force. While these locking mechanisms work for most crash situations, high acceleration impact, extensive sheet metal deformation, or vehicle rollover may result in forces that require more sophisticated locking mechanisms.

As another example of an extreme loading condition, in some instances, the cable linked to the door latch mechanism may become frozen in place or portions of the latch mechanism may become bound (for example, due to corrosion). When this happens, it is not uncommon for the person trying to open the door to pull the handle strap portion of the handle assembly even harder in order to force the door open by putting all of their strength or weight into the pulling the handle strap portion. However, the application of extreme loads to the handle assembly in order to try to actuate the latch mechanism to open the door when the door is in fact stuck, can potentially result in further damage to the components of the handle assembly requiring significant increase in component size and or component material type to withstand such excessive loads.

Accordingly, there remains a need for improved handle assemblies that are capable of withstanding extreme loading conditions of various kinds in an efficient manner.

SUMMARY

Disclosed herein are handle assemblies with components that are selectively decoupleable from one another along the force transmission path from the handle strap portion to the cable. By virtue of selective decoupling of the components, unintentional opening of the door by the handle assembly under high inertia loads might be prevented. Further, damage to the door might be avoided if a user attempts to force a bound door open by use of excessive force. In one form, this selective decoupling is achieved by use of a sliding latch release member in which the latch release member operatively links the various elements along the force transmission path in a first position, but does not in another. In another form, this selective decoupling is achieved by use of a slip clutch assembly disposed along the force transmission path in which the slip clutch assembly will not transmit excessive forces along the force transmission path. The disclosed handle assemblies include one or both of these structures for selective decoupling.

According to one aspect of the invention, a handle assembly is disclosed for a motor vehicle door. The handle assembly includes a base for attachment to the motor vehicle door and a handle strap extending between a handle end and a base end. The handle strap is pivotal about the base end. The handle end extends through an aperture in the base and has an engagement leg on it. The handle assembly further includes a rotatable structure rotatably coupled to the base about an axis of rotation. The rotatable structure includes a pin substantially parallel with and spaced from the axis of rotation of the rotatable structure. The rotatable structure is positioned to engage the engagement leg on the handle end of the handle strap to effectuate rotation of the rotatable structure about the axis of rotation of the rotatable structure (and therefore causes the orbiting of the pin about the axis of rotation of the rotatable structure). The handle assembly further includes a latch release member that is slidable between a first disengaged position and a second engaged position. Further, the latch release member is rotatable about an axis of rotation that is substantially perpendicular to the direction that the latch release member is movable and that is substantially parallel with the axis of rotation of the rotatable structure. The latch release member has a slot formed therein that receives the pin from the rotatable structure and selectively engages the pin. The slot is shaped and the pin is disposed such that, when the latch release member is in the first disengaged position, the rotation of the pin does not effectuate the rotation of the latch release member (as, for example, the pin travels through a portion of the slot shaped to match the path of travel of the pin and, accordingly, the pin does not apply a substantial force to the latch release member to cause the rotation of the latch release member). However, when the latch release member is actuated into the second engaged position, the rotation of the pin engages the latch release member to effectuate the rotation of the latch release member.

In some forms, the handle assembly may further include an actuator that actuates the latch release member between the first disengaged position and the second engaged position.

Such an actuator may be a linear actuator and may have an engagement end engaging the latch release member. In such a form, it is contemplated that one or both of the engaging surfaces of the engagement end of the linear actuator and the latch release member may be oblique to a direction of linear actuation of the linear actuator.

The handle assembly may also include a biasing member that biases the latch release member into the first disengaged position. When an actuator is employed, this actuator may be used to overcome the biasing member and actuate the latch release member from the first disengaged position to the second engaged position.

The handle assembly may further include a sensor in the handle strap configured to detect the presence of a hand in the handle strap. For example, the sensor in the handle strap might be a capacitive sensor. The handle assembly may be configured to actuate the actuator based on the condition of the sensor. For example, when a hand is not detected in the handle strap, the latch release member may remain in the first disengaged position. However, when a hand is detected in the handle strap, the actuator may actuate the latch release member from the first disengaged position to the second engaged position.

In some forms of the handle assembly, the latch release member may be configured to receive an end of a cable for unlatching the door. When a cable is attached to the latch release member in the fully assembled door, pulling the handle strap relative to the base causes the rotatable structure (and its associated pin) to rotate, which in turn effectuates rotation of the latch release member when latch release member is in the engaged position, thereby pulling the cable to unlatch the motor vehicle door.

The rotatable structure may be a slip clutch assembly configured to selectively transmit rotational loads under a pre-established value. For example, if a mechanical component is stuck in place due to icing or corrosion, this slip clutch may provide an engineered point of decoupling along the chain of force transmission from the handle strap to the cable.

The slip clutch assembly can include a first member and a second member having a biasing member between them and a third member that includes the pin. The first member, the second member, and the third member can all be positioned along, and be rotatable about, the axis of rotation of the rotatable structure. One of the first member and the second member may be configured for engagement with the leg of the handle end of the handle strap to effectuate rotation of at least part of the slip clutch assembly on its axis of rotation. The first member and the second member may be axially slidably coupled to one another such that the biasing member between them applies a biasing force that (1) biases the first member and the second member axially apart from one and (2) biases the second member into engagement with the third member at interfacing surfaces thereof. The interfacing surfaces of the second member and the third member can include face cams that couple rotation of the second member and third member together, unless the biasing force of the biasing member is overcome. If the biasing force is overcome, then second member and the third member may be decoupled from one another and the force above the pre-established value will not be transmitted through the rotatable structure/slip clutch assembly.

According to another aspect of the invention, a handle assembly for a motor vehicle door is disclosed having the slip clutch assembly independent of the slideable and rotatable latch release member. Again, this handle assembly includes a base for attachment to the motor vehicle door and a handle strap extending between a handle end and a base end. The handle strap is pivotal about the base end. The handle end extends through an aperture in the base and has an engagement leg. The handle assembly includes a slip clutch assembly such as, for example, the one described above, that is disposed along a path of force transmission for the handle assembly. The slip clutch assembly includes a first member, a second member, and a third member all positioned along and rotatable about an axis of rotation. One of the first member and the second member are configured for engagement with the leg of the handle end of the handle strap to effectuate rotation of at least part of the slip clutch assembly (or all the slip clutch assembly, depending of the magnitude of the force being transmitted therethrough). The first member and the second member are axially slidably coupled to one another and have a biasing member therebetween. This biasing member may be, for example, a compression spring. This biasing member applies a biasing force that (1) biases the first member and the second member axially apart from one another and (2) biases the second member into engagement with a third member at interfacing surfaces thereof. These interfacing surfaces include face cams that couple rotation of the second member and third member together, unless the biasing force of the biasing member is overcome. If the biasing force of the biasing member is overcome, then rotation of the second member and the third member are decoupled from one another.

In one form of this handle assembly, the third member may include a pin that rotatably engages a latch release member. This latch release member may be configured to receive an end of a cable for unlatching the motor vehicle door, such that a rotation of the latch release member (selectively effectuated by engagement with the pin) pulls the cable to unlatch the motor vehicle door.

In an alternative form of this handle assembly, the third member itself may be configured to receive an end of a cable for unlatching the door, such that a rotation of the third member pulls the cable to unlatch the motor vehicle door. In this form, there may be no separate latch release member as in the first described embodiment.

In one form of this handle assembly, the first and second members may include shaft portions including a key and slot engagement that accommodates axial displacement of the first member and second member relative to one another, but that maintains rotational coupling of the first member to the second member.

The forces above and below which this slip clutch assembly transmits rotational force may be adjusted by selection of the biasing force applied by the biasing member. In one form, the biasing force applied by the biasing member may be 120 N and any rotational force above 120 N causes the biasing force to be overcome, thereby decoupling the face cams of the second member from the third member and moving the first member and the second member closer together. It is noted that typical force ranges for opening the door by a user are significantly below 100 N.

It is also contemplated that the first member of the slip clutch assembly might be omitted while achieving the same end functionality. For example, the portion of the slip clutch assembly that engages the leg may be on the second member and the biasing member might apply a biasing force between the base and the second member to selectively maintain engagement between the engagement surfaces of the second and third members.

Various combinations of the features described above may be combined with one another according to different aspects of the invention. Of course, there may be some feature combinations which may be inconsistent or incompatible with one another that would be omitted where one of ordinary skill in the art would be able to derive this incompatibility or non-combinability from a reading of this disclosure.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENTS

Figure 1:
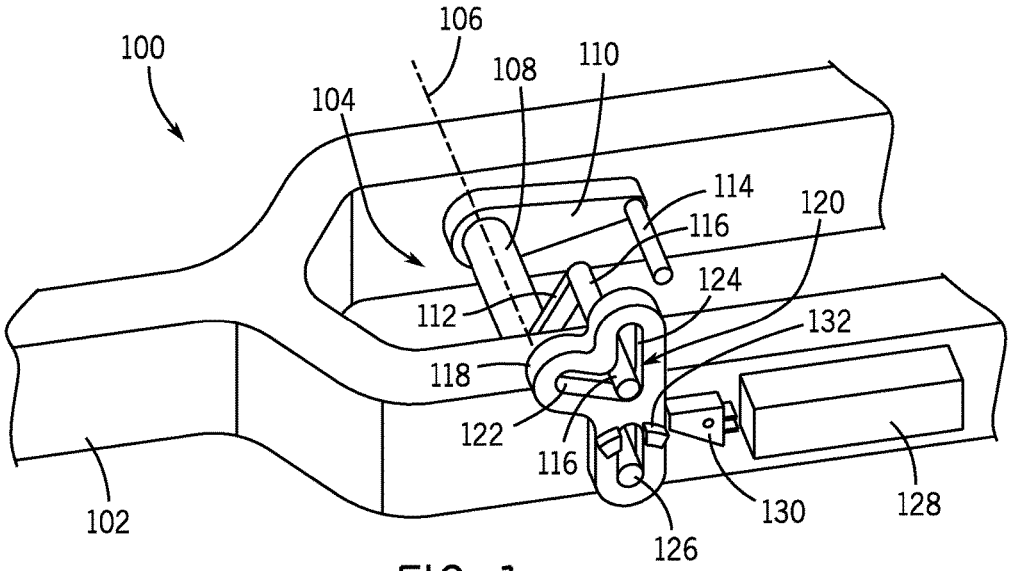
FIG. 1 is a conceptual illustration of one form of a slidable latch release member in which the latch release member is biased upward relative to the orientation on the page.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figures 2A, 2B:
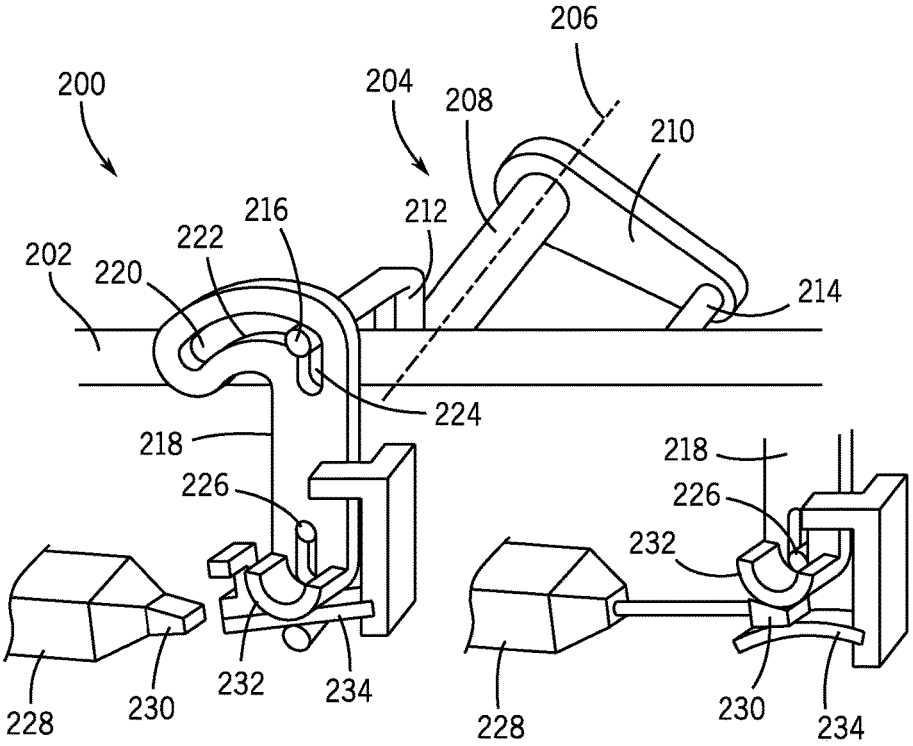
FIG. 2A is a conceptual illustration of one form of a slidable latch release member in which the latch release member is biased downward relative to the orientation on the page.
FIG. 2B is a detailed view of a partial area of FIG. 2A in which the actuator has been deployed to overcome a biasing force applied to the latch release member to move the latch release member to an engaged position.

FIGS. 1, 2A and 2B provide conceptual illustrations of a portion of a handle assembly 100, 200 for a door of a vehicle in which a slidable latch release member is employed. In both instances, only a base 102, 202 of the handle assembly 100, 200 is illustrated along with some of the attached components and the handle strap is omitted for the sake of clarity.

Of the illustrated components in these figures, there is a rotating structure 104, 204 that is rotatable about an axis of axis of rotation 106, 206. These rotating structures 104, 204 include a central shaft 108, 208 that lies along the axis of rotation 106, 206. Radially extending arms 110, 210 and 112, 212 connect the central shaft 108, 208 to a bar 114, 214 and a pin 116, 216, respectively, which are both parallel with, but spaced from the central shaft 108, 208 and its axis of rotation 106, 206.

When the handle strap portion of the handle is pulled, the bar 114, 214 is positioned such that it is engaged by a leg on the handle end of handle strap (not shown) and such that the bar 114, 214 is lifted upwards. This causes the rotating structure 104, 204 to rotate counter-clockwise from the perspective of illustration, thereby causing the pin 116, 216 to also orbitally rotate counter-clockwise about the axis of rotation 106, 206 to selectively engage a slideable latch release member 118, 218.

The latch release member 118, 218 is movably connected to the base 102, 202. The latch release member 118, 218 is both slideable in an upwards-downwards direction (relative to the page) between a first disengaged position and a second engaged position. In FIGS. 1 and 2A, the latch release members 118, 218 are illustrated in the first disengaged position. Further, in at least the second engaged position, the latch release member 118, 218 is rotatable. Although it is not shown in FIGS. 1 and 2A, the latch release member 118, 218 may have a structure formed thereon that is configured for attachment to a cable (this feature is illustrated in some of the subsequently illustrated embodiments). Accordingly, when a cable is attached to the latch release member 118, 218 and the latch release member 118, 218 is rotated, the cable may be pulled to release the latch for the door.

The latch release member 118, 218 has a slot 120, 220 formed in it that receives the pin 116, 216 of the rotating structure 104, 204. From the illustrated perspective, the slot 120, 220 has a generally horizontally-extending portion 122, 222 and a generally vertically-extending portion 124, 224. When the pin 116, 216 rotates counter-clockwise during the pulling of the handle strap, if the pin 116, 216 travels through the generally horizontally-extending portion 122, 222, then the latch release member 118, 218 will not rotate as the path of travel of the pin 116, 216 follows the generally horizontally-extending portion 112, 222 of the slot 120, 220 during the rotation of the pin 116, 216 without actuating the latch release member 118, 218. However, if the pin 116, 216 is disposed in the generally vertically-extending portion 124, 224 of the slot 120, 220 and the pin 116, 216 is made to rotate, then the latch release member 118, 218 will be made to rotate about an axis of rotation guided and defined by the lower guide pin 126, 226 for the latch release member 118, 218.

In order to actuate or slide the latch release member 118, 218 between the first disengaged position and the second engaged position, there is an actuator 128, 228 mounted to the side of the base 102, 202. The actuator 128, 228 may be extended when a hand of a user is detected on or near the handle strap (using a capacitive sensor of the like built into the handle strap). The end 130, 230 of the actuator 128, 228 has an oblique engagement surface that, when extended, contacts an oblique engagement surface 132, 232 of the latch release member 118, 218 in order to actuate the latch release member 118, 218 from the disengaged to the engaged position.

In the form illustrated, the latch release member 118, 218 translates perpendicular to the direction of linear actuation upon movement between the engaged and disengaged positions. However, it is contemplated that if the actuator is differently oriented, that the use of oblique engagement surfaces on one or both of the actuator and the latch release member might be avoided.

Further, the latch release members 118, 218 are biased into the disengaged positions illustrated in FIGS. 1 and 2A using biasing members. As best shown in FIG. 2A, a leaf spring 234 biases the latch release member 118 into the disengaged position. However, the actuator 228 can be used to overcome the biasing member 234 as illustrated in the right, partial detail view of FIG. 2B to overcome the biasing force and move the latch release member 118 to the engaged position.

It should be noted that FIGS. 1 and 2 illustrate two different configurations for the latch release members 118, 218 that provide similar functionality despite differences in the structure and direction of biasing of the latch release members 118, 218. In FIG. 1, the latch release member 118 is shown in the disengaged position in which the latch release member 118 is upwardly biased (albeit by a biasing member that is not illustrated). If the actuator 128 is used to cause the latch release member 118 to slide to the engaged position, then the latch release member 118 will be slid downward relative to what is illustrated in FIG. 1. In contrast, in FIG. 2A, the latch release member 218 is biased downwardly to the disengaged position. If the actuator 228 is used to move the latch release member 218, then the latch release member 218 is slid upward into the engaged position by the actuator 228. Even though the geometric arrangements are different, the mechanical effect obtained (that is, potential engagement with the pin 116, 216 based on the position of the latch release member 118, 218) is similar based on the geometry of the slots 120, 220 and relative position of the latch release member 118, 218.

Notably, the latch release member 118, 218 is used to selectively couple the rotating structure 104, 204 to a cable to permit release of the latch to open the door. When a user's hand is detected by a capacitive sensor in the handle strap (or another sensor is used to detect that the strap is being engaged in a normal door opening operation), then the actuator 128, 228 is actuated to slide the latch release member 118, 218 to the engaged position in which the rotation of the rotating structure 104, 204 is transmitted to the latch release member 118, 218 (thereby completing the path of force transmission to permit the use of the handle strap to pull the release cable and unlatch the door). However, when no user intent is detected (because the capacitive sensor does not detect a hand in or on the strap or other sensor does not detect a user nearby under conditions in which the door might be safely opened), then the actuator returns to the un-extended position and the latch release member 118, 218 returns to the disengaged position (in some forms, under the applied biasing force). In this disengaged position, the rotation of the rotating member 104, 204 does not cause the latch release member 118, 218 to be rotated (since the pin 116, 216 would merely travel in the portion 122, 222 of the slot 120, 220 without rotating the latch release member 118, 218), and thereby decouples the strap from the release cable, breaking or disconnecting the path of force transmission.

Referring now to FIGS. 3 through 6, a handle assembly 300 that better and more fully illustrates the use of a slidable latch release member 318 is depicted. Again, the handle assembly 300 includes a base 302 for attachment to the motor vehicle door. However, unlike FIGS. 1, 2A and 2B, FIGS. 3 through 5 also show the handle strap 336 that is connected to the base 302. The handle strap 336 is pivotally connected to the base 302 at a base end 338 of the handle strap 336 (which is just off the left edge of the figure in FIGS. 3 and 4A). The handle strap 336 also has a handle end 340 that extends downwardly through an opening or aperture 342 in the base 302. At the lower end of the handle end 340, there is an engagement leg 344 (viewable at the very bottom of the illustrations in FIGS. 3, 4A, and 5) that is positioned to lift the bar (similar to bar 114, 214, but not illustrated in FIGS. 3, 4A, and 5) on the rotating structure 304.

Although it will not be described in great detail at this juncture (a similar, although not identical, assembly will be described below with respect to FIGS. 7 through 11), the rotating structure 304 is, in the form illustrated, a slip clutch assembly having a first member 304*a* and a second member 304*b* with a biasing member 304*c* positioned therebetween (which in the form illustrated is a compression spring). The slip clutch assembly also includes third member 304*d* that supports the pin 316. The first member 304*a*, the second member 304*b*, and the third member 304*d* are all positioned along and rotatable about the axis of rotation 306 of the rotatable structure 304. In the illustrated form, one of the first member 304*a* and the second member 304*b* are configured for engagement with the leg 344 of the handle end 340 of the handle strap 336 to effectuate rotation of at least part of the slip clutch assembly.

The first member 304*a* and the second member 304*b* are axially slidably coupled to one another and the biasing member 304*c* therebetween applies a biasing force that biases the first member 304*a* and the second member 304*b* axially apart from one another and biases the second member 304*b* into engagement with the third member 304*d* at interfacing surfaces between the two members. As will be described in greater detail below, the interfacing surfaces of the second member 304*b* and the third member 304*d* include face cams that couple rotation of the second member 304*b* and third member 304*d* together. This coupling is maintained unless the biasing force of the biasing member 304*c* is overcome or exceeded thereby causing the biasing member 304*c* to compress and the first and second member 304*a* and 304*b* to collapse into one another. In this case with the second member 304*b* being moved, the second member 304*b* and the third member 304*d* are mechanically separated and decoupled from one another resulting in the decoupling of their rotation from one another.

Thus, the slip clutch assembly permits the transmission of forces through it that are below the pre-determined or pre-established threshold values for the biasing member

304*c*, but disconnects the path of force transmission at extreme loads in excess of the pre-determined or pre-established threshold values.

Figure 3:
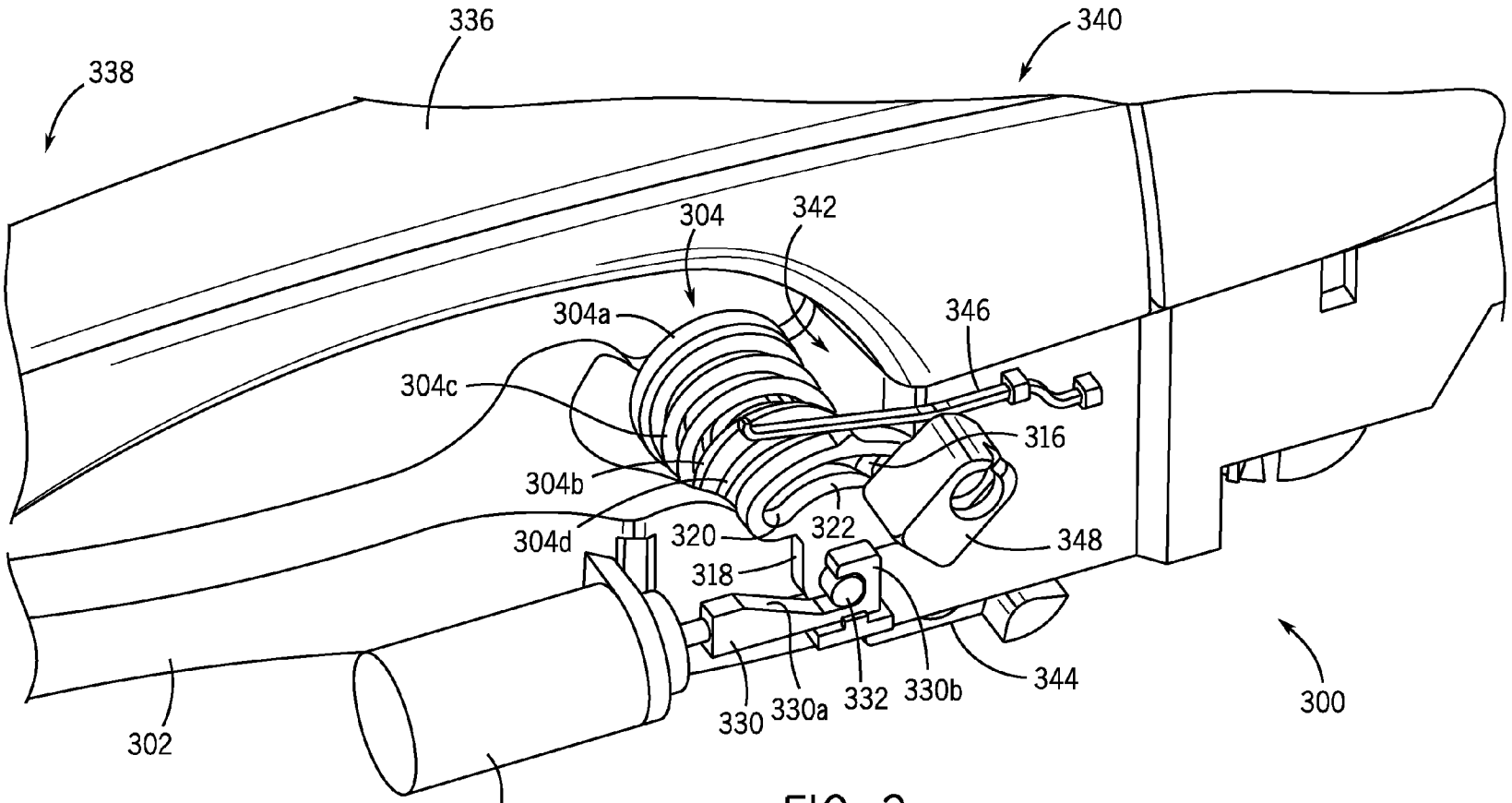
FIG. 3 is side perspective view of a handle assembly according to a first embodiment in which the handle assembly includes a slip clutch assembly and a slidable latch release member that is actuatable by an actuator.
Figure 4A:
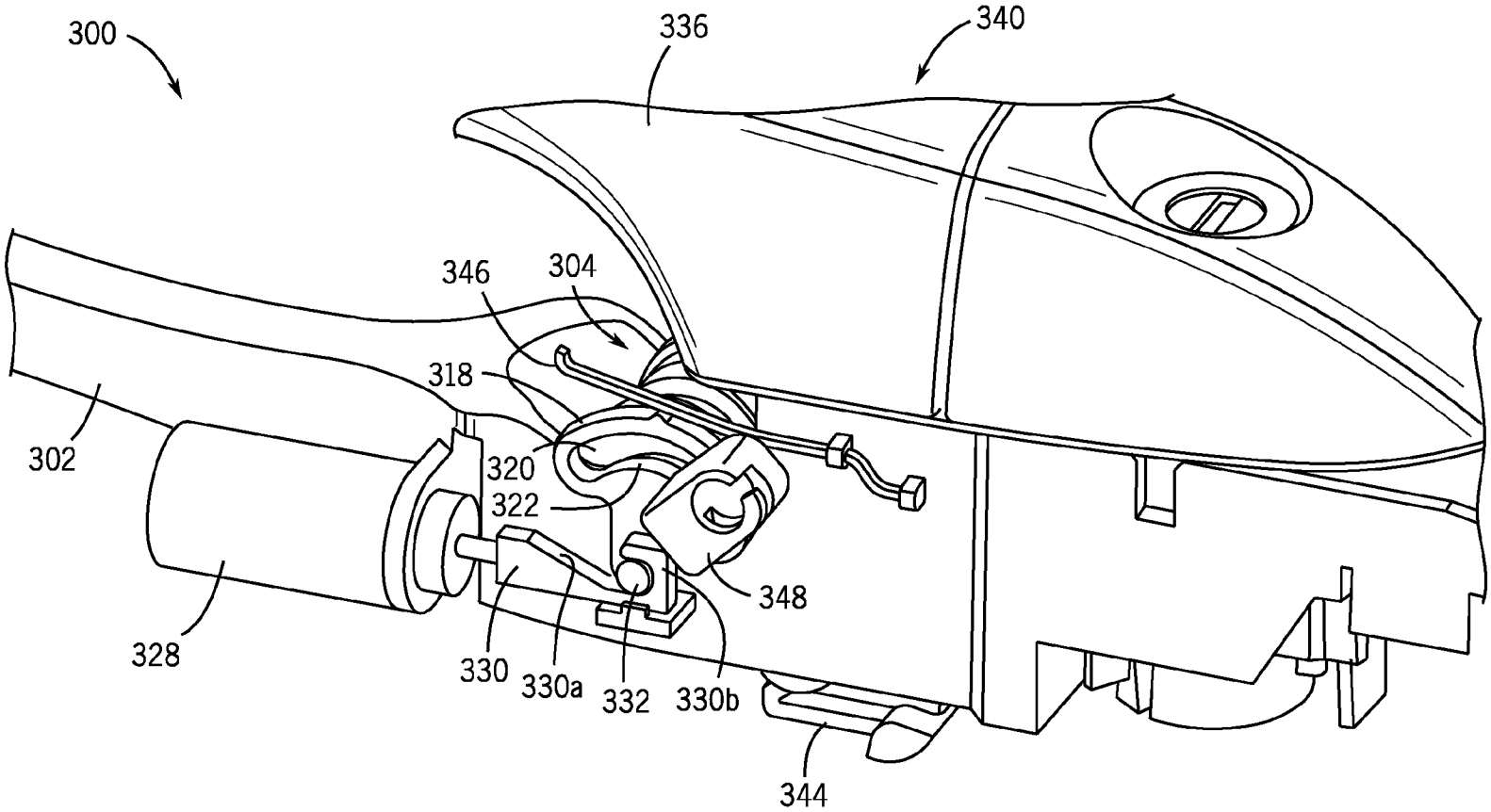
FIGS. 4A though 4C is a different perspective view of the handle assembly of FIG. 3 from the same side in which the various steps of moving the latch release member from a disengaged position to an engaged position and further rotating the engaged latch release member as sequentially shown.
Figure 4B:
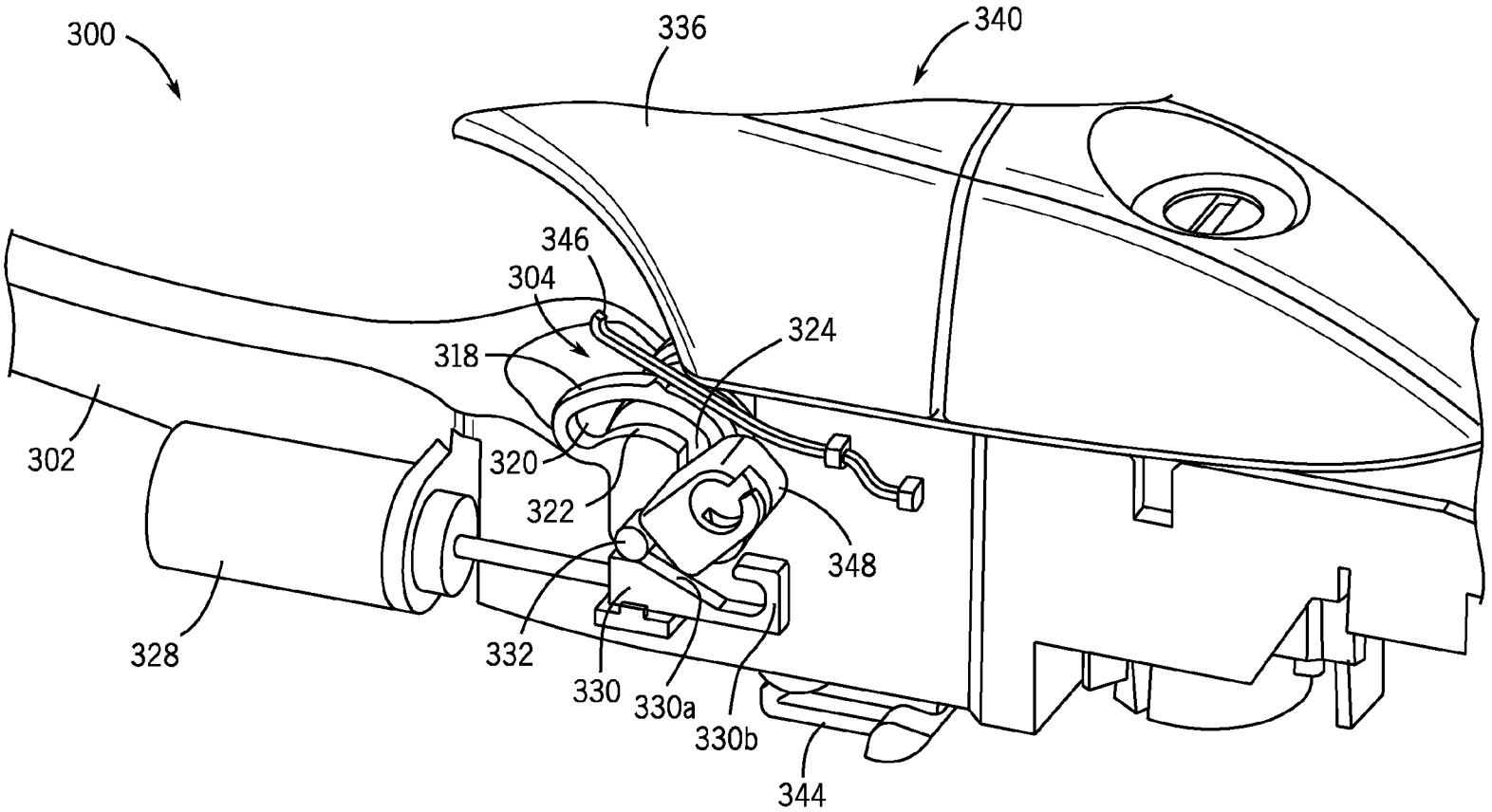
Figure 4C:
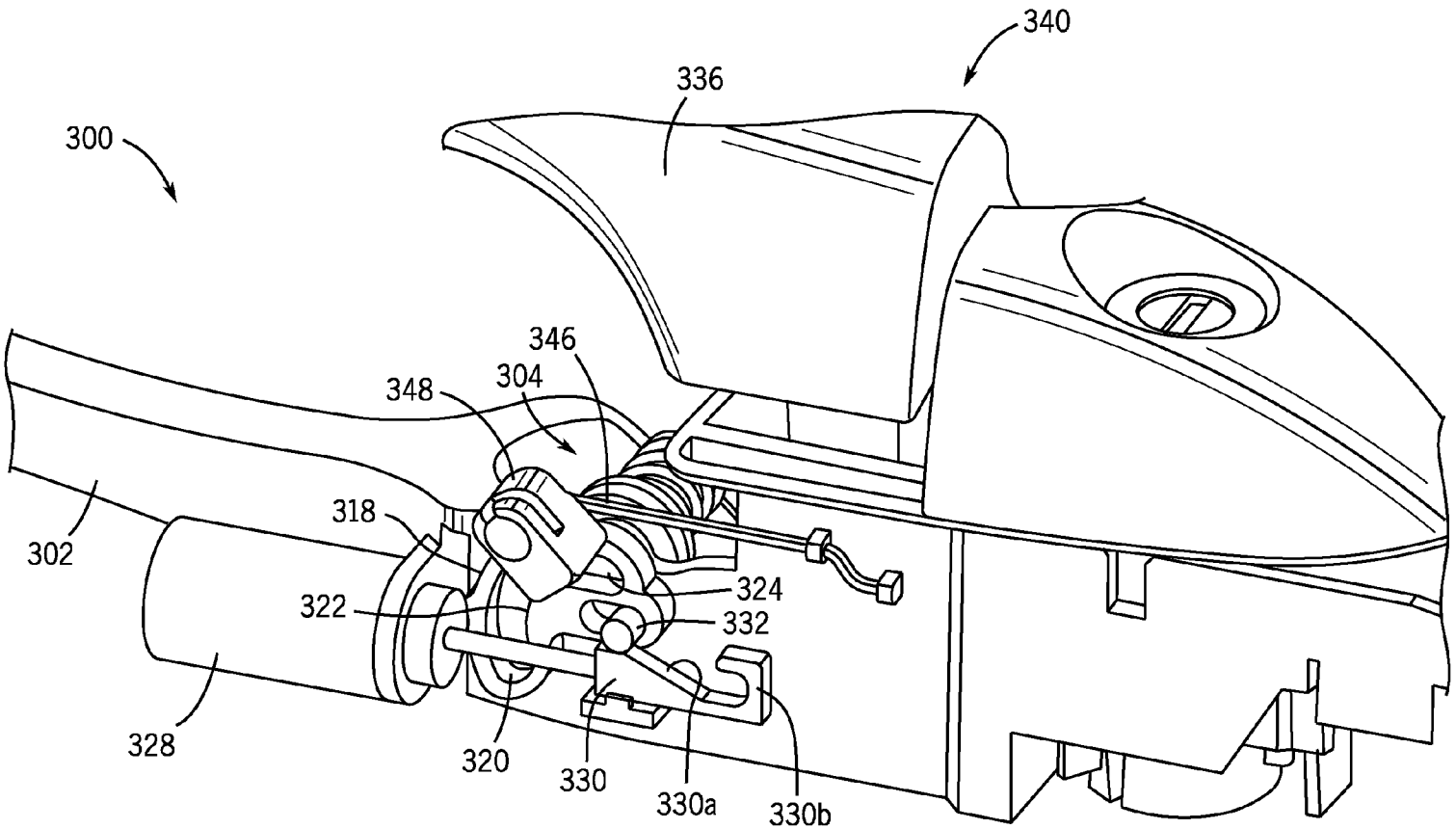
Figure 5:
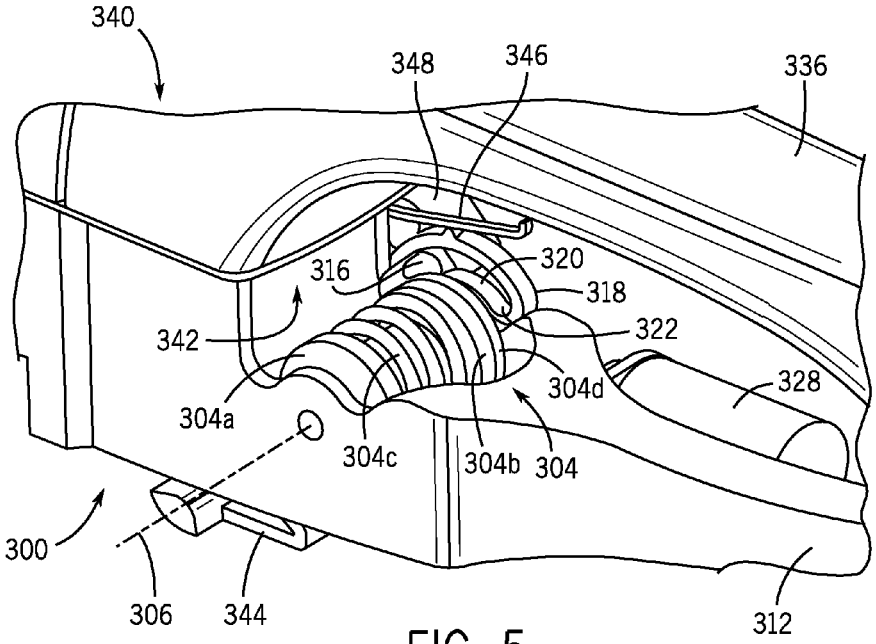
FIG. 5 is a reverse perspective view of the handle assembly from FIGS. 3 and 4A through 4C.
Figure 6:
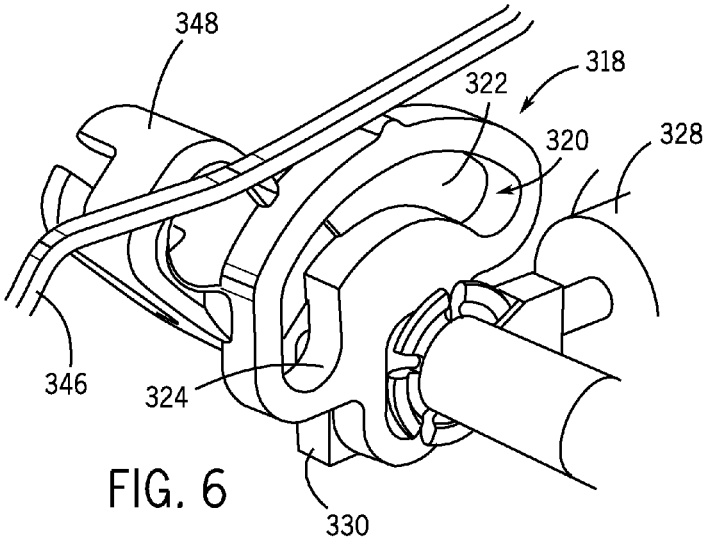
FIG. 6 is a perspective view of a portion of the assembly (with some parts removed, such as the base) better detailing the shape of the slot in the latch release member.
Figure 7:
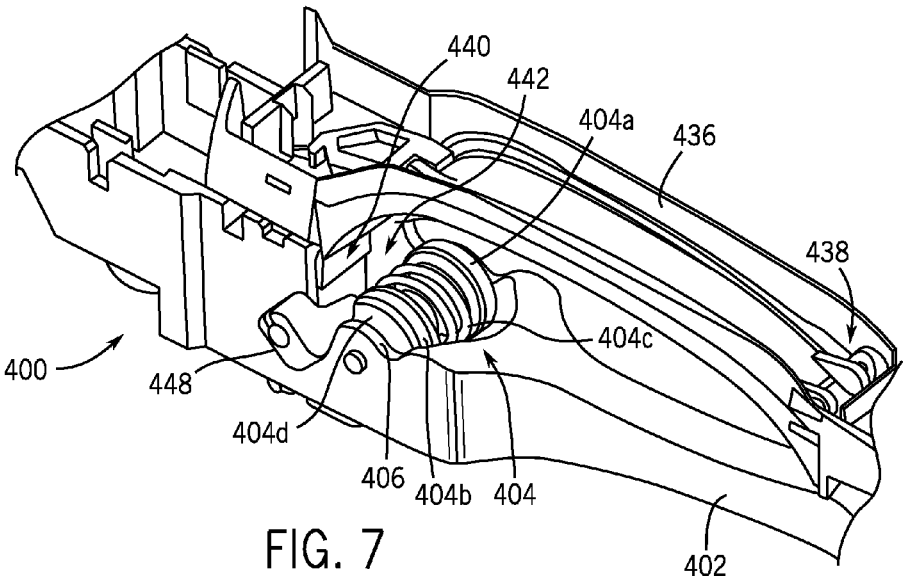
FIG. 7 is a side perspective view of a second embodiment of a handle assembly in which the handle assembly includes a slip clutch assembly (but not a slidable latch release member).
Figure 8:
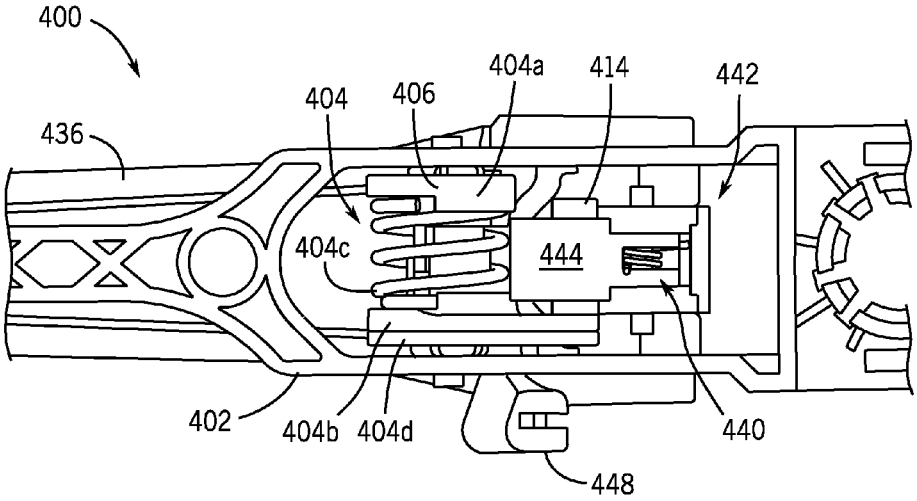
FIG. 8 is a bottom view of the handle assembly of FIG. 7.

In the embodiment illustrated in FIGS. 3 through 6, the latch release member 318 is again slidably connected to the base 302 such that the latch release member 318 is movable between a first disengaged position (as illustrated in FIGS. 3 through 5) and a second engaged position (not illustrated, but would be one in which the latch release member 318 has been shifted upward relative to the illustrated orientation in the figures). In the particular embodiment illustrated in FIG. 4A, a spring pin 346 applies a downwardly biasing force to the top of the latch release member 318 to keep the latch release member 318 in the disengaged position (unless this biasing force is overcome by the actuator 328, as will be described below). Also, the latch release member 318 is further rotatable about an axis of rotation substantially perpendicular to the direction that the latch release member 318 is slidably movable and that is parallel to (and in some forms, co-axial with) the axis of rotation 306 of the rotatable structure 304.

Just as in the conceptual illustrations in FIGS. 1 and 2, when the bar (the structural equivalent of 114, 214) is lifted by pulling the handle strap 336 relative to the base 302 to cause the leg 344 to lift the bar, the rotating structure 304 rotates on its axis of rotation 306, and the pin 316 is made to orbit the axis of rotation 306 and selectively engage the latch release member 318.

Again, an actuator 328 is illustrated that is actuated based on the state of a capacitive sensor in the handle strap 336 (or another sensor that is able to detect whether the strap 336 is being pulled by a legitimate and intended user action, as opposed to being moved by inertial forces imposed during a collision or accident). In the form illustrated in FIG. 4A, the actuator 328 is retracted as no hand has been sensed by the capacitive sensor. This causes the latch release member 318 to be retained in the down position such that, if the pin 316 is rotated, the pin 316 travels through the generally horizontally-extending portion 322 of the slot 320 (best illustrated in the rear view of FIG. 6) without effectuating the rotation of the latch release member 318 that would cause the movement of the cable attachment structure 348 on the latch release member 318 to pull the attached cable (not illustrated) to unlatch the door. However, as illustrated in FIG. 4B if the actuator 328 is extended by virtue of detection of a user's hand in the handle strap 336, then a ramp 330*a* on the ramped hook 330 (i.e., the actuated end) engages the surface on the dowel 332 of the latch release member 318 to slide it upwards to the engaged position in which the pin 316 is moved into the generally vertically-extending portion 324 of the slot 320. In this engaged position, when the pin 316 rotates by pulling the handle strap 336, the pin 316 engages and effectuates rotation of the latch release member 318 (about axis of rotation 306 in the illustrated embodiment) and its attached cable attachment structure 348 to pull the cable and unlatch the door as is illustrated in FIG. 4C.

It will be further noted that the ramped hook 330 includes a hooked tip 330*b* that captures a dowel 332 of the latch release member 318 when the latch release member 318 is in the disengaged position (and conversely is cleared of the dowel 332 end to permit upward movement of the latch release member 318, when it is actuated). This hooked tip 330*b* can prevent the upward sliding of the latch release member 318 due to inertial forces or other external forces other than that imposed by the actuator 328. Further, the actuator 328 may be biased into the closed or locked position illustrated in FIG. 3 such that it would require forces in excess of typical forces applied during an accident in order to actuate the ramped hook 330. In this way, the latch release member 318 may be retained in the disengaged position unless expressly actuated by the actuator 328.

Turning now to FIGS. 7 through 11, yet another embodiment of a handle assembly 400 is illustrated in which there is not a slidable latch release mechanism or electrically-activated actuator as in the previously described embodiments. Instead, the handle assembly 400 only includes a slip clutch assembly in the rotating structure 404 that is adapted to prevent the transmission of forces above the pre-established threshold force through the path of force transmission from the handle strap 436 to the cable (not illustrated in these views, but would be similar to the handle strap from FIGS. 3 through 5).

The biggest difference between FIGS. 7 through 8 and FIGS. 3 through 5 is that, because there is no longer a slidable latch release member along the force transmission path (or actuator for actuating a latch release member), the third member 404*d* is modified. The third member 404*d* no longer supports the pin, as there is no slotted latch release member for this pin to engage with. Now instead, the cable release structure 448 is located on the third member 404*d* of the slip clutch assembly and moves with the rotation of the third member 404*d*.

Figure 9:
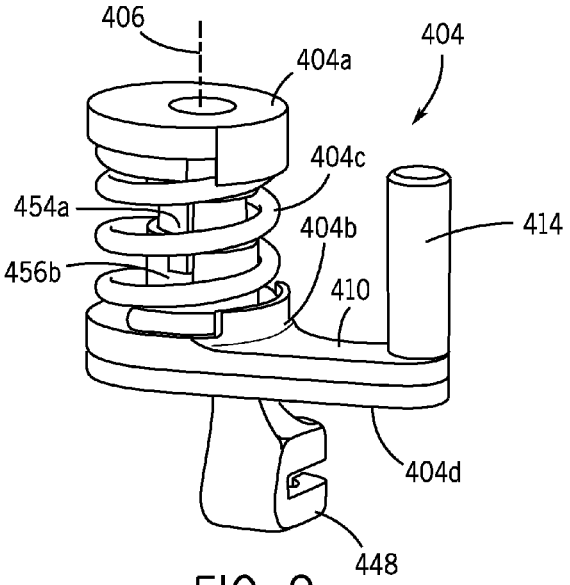
FIG. 9 is a view of the slip clutch assembly found in the handle assembly of FIG. 8 in which the slip clutch assembly is in an assembled state.
Figure 10:
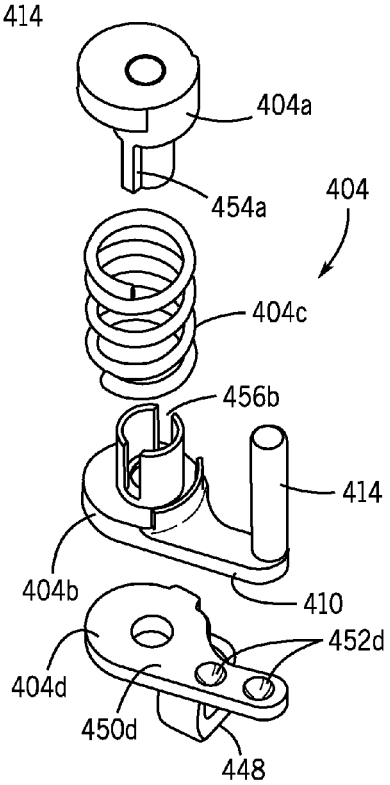
FIG. 10 is an exploded view of the slip clutch assembly of FIG. 9.
Figure 11:
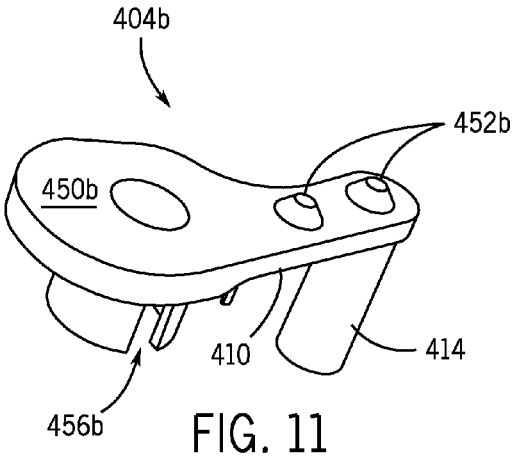
FIG. 11 is a reverse perspective view of one of the members of the slip clutch assembly from FIG. 10 to better illustrate some of the face cams on the member (as these cannot be readily seen in the perspective taken in FIG. 10).

Perhaps FIGS. 9 through 11 are the most illustrative of the rotatable structure 404 that is the slip clutch assembly, as the rotatable structure 404 is shown apart from the handle assembly 400. As noted elsewhere, the rotatable structure 404 includes a first member 404*a* and a second member 404*b* with a biasing member 404*c* the in the form of a compression spring between the two members 404*a* and 404*b*. There is also a third member 404*d* that contacts the second member 404*b* at two interfacing engagement surfaces, 450*b* and 450*d*. These interfacing engagement surfaces include face cam parts 452*b* and 452*d* that mate when the second member 404*b* and the third member 404*d* are coupled to one another for transmission of a force there between.

In the assembly, the first member 404*a* and the second member 404*b* are coupled to one another using an axially-extending key and slot arrangement in which a key 454*a* is formed on the first member 404*a* and a slot 456*b* is formed on the second member 404*b*. The key 454*a* is received in the slot 456*b*, such that the first member 404*a* and the second member 404*b* are rotationally locked relative to one another, but are axially movable with respect to one another.

As can be seen, the biasing member 404*c* is disposed between the first member 404*a* and the second member 404*b*, the biasing member 404*c* tends (1) to bias the first member 404*a* and the second member 404*b* axially apart from one another, as the biasing member 404*c* is compressed therebetween, and (2) to bias the engagement surface 450*b* of the second member 404*b* into the engagement surface 450*d* the third member 404*d*. In particular, the second condition results in the face cam parts 452*b* and 452*d* being forced into locked engagement with one another to lock the rotation of the second member 404*b* to the third member 404*d* as long as the biasing force is not overcome.

However, if one of the components binds up such as if, for example, the cable to which the third member 404*d* is connected is frozen in place, then the third member 404*d* may become similarly lodged in place. If a sufficiently large force is applied to the handle strap 436 (i.e., a force in excess of the biasing force applied by the biasing member 404*c*), then the face cam parts 452*b* and 452*d* disengage one another simultaneously with the first and second members

404*a* and 404*b* being displaced toward one another, against and overcoming the biasing force. This effectively rotationally decouples second and third members 404*b* and 404*d* from one another, disconnecting the path of transmission. Thus, by selecting a biasing force above the typical force used to operate the handle assembly, but below an excessive force at which components of the handle assembly or door might be damaged, the path of transmission is engineered to decouple under extreme loads.

It is contemplated that the first member 404*a* might be omitted from the slip clutch assembly without compromising the functionality of the slip clutch assembly. For example, the biasing member might be disposed between a side wall of the base and the second member (which also includes the bar which is lifted by the movement of the leg on the handle strap when the handle strap is pulled). Then, under loading in excess of the biasing force, the second member slides towards the sidewall of the base against the biasing force to separate the second member from the third member and decouple the second and third members from one another. However, below the biasing force, the face cam parts lock the rotation of the second member to the third member to maintain the path of force transmission.

In sum, handle assemblies are disclosed that selectively decouple when extreme or excessive forces are applied to avoid an unintentional opening of the door or damage to the components of the handle assemblies. They may include a deployable latch release member within the handle bracket which in its non-deployed state prevents the completion of the unlatching load path from the handle assembly to the door latch. Thus, undesired loading on the latch system during crash events by the door handle are not experienced. This assembly may also or alternatively provide a means of dealing with the loads associated with frozen cables, bound latches or other generation of high system loads. The device is tuned to a desired break away force so that below that threshold the handle pulls on the cable release mechanism and it acts as a single member, actuating the cable. Should resistive loads from the cable assembly become greater that the threshold value, then the cable actuating assembly will separate, allowing the handle to travel to full extension without experiencing the high loads.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A handle assembly for a motor vehicle door, the handle assembly comprising:

a base for attachment to the motor vehicle door;

a handle strap extending between a handle end and a base end in which the handle strap is pivotal about the base end and in which the handle end extends through an aperture in the base, the handle end having an engagement leg;

a rotatable structure rotatably coupled to the base about an axis of rotation and including a pin substantially parallel with and spaced from the axis of rotation of the rotatable structure, the rotatable structure positioned to engage the engagement leg on the handle end of the handle strap to effectuate rotation of the rotatable structure about the axis of rotation of the rotatable structure;

a latch release member that is slidably connected to the base such that the latch release member is configured to move between a disengaged position and an engaged position and that is further rotatable about an axis of rotation substantially perpendicular to the direction that the latch release member is movable and that is parallel to the axis of rotation of the rotatable structure, the latch release member having a slot formed therein that receives the pin from the rotatable structure for selective engagement therewith and is shaped such that, when the latch release member is in the disengaged position, the rotation of the pin does not effectuate the rotation of the latch release member and, when the latch release member is actuated into the engaged position, the rotation of the pin does engage the latch release member to effectuate the rotation of the latch release member.

2. The handle assembly of claim 1, further comprising an actuator that actuates the latch release member between the disengaged position and the engaged position.

3. The handle assembly of claim 2, wherein the actuator is a linear actuator and has an engagement end engaging the latch release member and wherein at least one of the engaging surfaces of the engagement end of the linear actuator and the latch release member are oblique to a direction of linear actuation of the linear actuator.

4. The handle assembly of claim 2, further comprising a biasing member that biases the latch release member into the disengaged position and wherein the actuator is used to overcome the biasing member and actuate the latch release member to the engaged position.

5. The handle assembly of claim 2, further comprising a sensor in the handle strap configured to detect the presence of a hand in the handle strap and wherein the handle assembly is configured to actuate the actuator based on the condition of the sensor such that, when a hand is not detected in the handle strap, the latch release member remains in the disengaged position and, when a hand is detected in the handle strap, the actuator actuates the latch release member to the engaged position.

6. The handle assembly of claim 5, wherein the sensor in the handle strap is a capacitive sensor.

7. The handle assembly of claim 1, wherein the latch release member is configured to receive an end of a cable for unlatching the door, such that a rotation of the latch release member pulls the cable to unlatch the motor vehicle door.

8. The handle assembly of claim 1, wherein the rotatable structure is a slip clutch assembly configured to selectively transmit rotational loads under a pre-established value.

9. The handle assembly of claim 8, wherein the slip clutch assembly comprises a first member and a second member having a biasing member therebetween and a third member that includes the pin, in which the first member, the second member, and the third member are all positioned along and rotatable about the axis of rotation of the rotatable structure;

wherein one of the first member and the second member are configured for engagement with the leg of the handle end of the handle strap to effectuate rotation of at least part of the slip clutch assembly;

wherein the first member and the second member are axially slidably coupled to one another and the biasing member therebetween applies a biasing force that biases the first member and the second member axially apart from one another and biases the second member into engagement with the third member at interfacing surfaces thereof; and wherein the interfacing surfaces of the second member and the third member include face cams that couple rotation of the second member and third member together, unless the biasing force of the biasing member is overcome in which case rotation of the second member and the third member are decoupled from one another.

* * * * *